US007681565B2

(12) United States Patent
Fujiki

(10) Patent No.: US 7,681,565 B2
(45) Date of Patent: Mar. 23, 2010

(54) AIR/FUEL RATIO CONTROL SYSTEM FOR INTERNAL COMBUSTION ENGINE

(75) Inventor: Kenichi Fujiki, Toyoake (JP)

(73) Assignee: DENSO Corporation, Kariya (JP)

( * ) Notice: Subject to any disclaimer, the term of this patent is extended or adjusted under 35 U.S.C. 154(b) by 14 days.

(21) Appl. No.: 12/047,538

(22) Filed: Mar. 13, 2008

(65) Prior Publication Data

US 2008/0236555 A1 Oct. 2, 2008

(30) Foreign Application Priority Data

Mar. 30, 2007 (JP) ..... 2007-090429

(51) Int. Cl.
*F02D 41/00* (2006.01)

(52) U.S. Cl. ..... 123/673; 701/105

(58) Field of Classification Search ..... 123/673, 123/674, 688–690; 701/103–105, 107, 109, 701/114; 73/23.32, 31.05
See application file for complete search history.

(56) References Cited

U.S. PATENT DOCUMENTS

| | | | | |
|---|---|---|---|---|
| 5,131,372 | A | 7/1992 | Nakaniwa | |
| 5,672,817 | A | 9/1997 | Sagisaka et al. | |
| 5,964,208 | A * | 10/1999 | Yamashita et al. | 123/674 |
| 6,032,659 | A * | 3/2000 | Yamashita et al. | 123/674 |
| 6,470,868 | B2 * | 10/2002 | Nakagawa et al. | 123/673 |
| 7,021,300 | B2 * | 4/2006 | Maki et al. | 123/688 |
| 7,225,800 | B2 * | 6/2007 | Nakagawa et al. | 123/673 |
| 7,441,554 | B2 * | 10/2008 | Nakagawa et al. | 123/673 |

FOREIGN PATENT DOCUMENTS

| | | |
|---|---|---|
| JP | 1-237336 | 9/1989 |
| JP | 2-301644 | 12/1990 |
| JP | 2004-3513 | 1/2004 |
| JP | 2005-337194 | 12/2005 |

* cited by examiner

*Primary Examiner*—Stephen K Cronin
*Assistant Examiner*—Johnny H Hoang
(74) *Attorney, Agent, or Firm*—Nixon & Vanderhye P.C.

(57) ABSTRACT

An air/fuel ratio control system is provided for an internal combustion engine having a plurality of cylinders and an air/fuel ratio sensor. The air/fuel ratio sensor is disposed at an exhaust gas merging portion of an exhaust passage where exhaust gas discharged from the plurality of cylinders merges together. The system includes an air/fuel ratio control device, an abnormality diagnosis device, and an enabling device. The air/fuel ratio control device individually controls an air/fuel ratio of each of the plurality of cylinders based on an output of the air/fuel ratio sensor. The abnormality diagnosis device determines whether abnormality of the air/fuel ratio sensor exists. The enabling device enables the air/fuel ratio control device to execute the controlling of the air/fuel ratio of each of the plurality of cylinders when the abnormality diagnosis device determines that the abnormality of the air/fuel ratio sensor does not exist after starting of the engine.

8 Claims, 2 Drawing Sheets

AIR/FUEL RATIO CONTROL SYSTEM FOR INTERNAL COMBUSTION ENGINE

CROSS REFERENCE TO RELATED APPLICATION

This application is based on and incorporates herein by reference Japanese Patent Application No. 2007-90429 filed on Mar. 30, 2007.

BACKGROUND OF THE INVENTION

1. Field of the Invention

The present invention relates to an air/fuel ratio control system for an internal combustion engine having a function of controlling an air/fuel ratio in each cylinder based on output of an air/fuel ratio sensor disposed in an exhaust air merging portion of the engine.

2. Description of Related Art

In most recent electronically controlled internal combustion engines, an air/fuel ratio sensor is disposed in an exhaust gas passage for detecting an air/fuel ratio of exhaust gas, and air/fuel ratio F/B control, whereby an air/fuel ratio (e.g., fuel injection quantity) in each cylinder is equally F/B (feedback) controlled such that an air/fuel ratio detected in the air/fuel ratio sensor accords with a target air/fuel ratio, is performed.

Furthermore, as described in JP2005-337194A, for example, the air/fuel ratio in each cylinder is estimated using a model, in which a detection value (air/fuel ratio at the exhaust air merging portion) of an air/fuel ratio sensor disposed in an exhaust air merging portion where exhaust gases from cylinders merge together is related with the air/fuel ratio in each cylinder. Based on the estimation result, each-cylinder air/fuel ratio control, whereby the air/fuel ratio (e.g., fuel injection quantity) in each cylinder is controlled so that a variation of the air/fuel ratios among the cylinders is small, is performed in order to improve air/fuel ratio control accuracy.

Also, as described, for example, in JP 2004-3513A corresponding to U.S. Pat. No. 5,672,817, in order to make an abnormal diagnosis of the air/fuel ratio sensor, an output change rate of the air/fuel ratio sensor in a predetermined period after the fuel injection cut-off in the engine is started is calculated as a responsivity detection value. Then, the output change rate of the air/fuel ratio sensor is compared with an abnormity determination value, to determine whether the air/fuel ratio sensor is abnormal (deterioration in responsivity).

Generally, although an abnormal electrical connection (e.g., a broken wire and a short circuit) in the air/fuel ratio sensor can be determined immediately after the engine is started (e.g., after an ignition switch is turned on), it cannot be determined, for example, whether the responsivity of the air/fuel ratio sensor is abnormal until the engine is in a predetermined operating condition (e.g., fuel injection cut-off state). In a system in which the air/fuel ratio F/B control, whereby the air/fuel ratio in each cylinder is equally controlled based on output of the air/fuel ratio sensor, is executed, the air/fuel ratio F/B control is started early on after the engine is started to reduce exhaust gas emission. Therefore, the air/fuel ratio F/B control is started at the time that a predetermined execution condition for the air/fuel ratio F/B control (e.g., the air/fuel ratio sensor is in an active state) is satisfied even before it is determined whether the responsivity of the air/fuel ratio sensor is abnormal. Then, if it is determined that the responsivity of the air/fuel ratio sensor is abnormal, the air/fuel ratio F/B control is forbidden at that point.

However, in the each-cylinder air/fuel ratio control, whereby the air/fuel ratio in each cylinder is controlled based on the output of the air/fuel ratio sensor, the air/fuel ratio in each cylinder is accurately estimated from the output of the air/fuel ratio sensor through the inverse operation, for example. Accordingly, the air/fuel ratio at the exhaust air merging portion varying with combustion in each cylinder needs to be detected in fast response in the air/fuel ratio sensor. As a result, higher-level responsivity of the air/fuel ratio sensor than general air/fuel ratio F/B control is required. When the each-cylinder air/fuel ratio control is started before it is determined whether the responsivity of the air/fuel ratio sensor is abnormal similar to the general air/fuel ratio F/B control, the each-cylinder air/fuel ratio control may be performed with the responsivity of the air/fuel ratio sensor deteriorated below the required level. In consequence, control accuracy in the each-cylinder air/fuel ratio control is deteriorated, and thereby the variation of the air/fuel ratios among the cylinders is large. Thus, a problem that exhaust gas emission is deteriorated is created.

SUMMARY OF THE INVENTION

The present invention addresses the above disadvantages. Thus, it is an objective of the present invention to provide an air/fuel ratio control system for an internal combustion engine, which prevents execution of each-cylinder air/fuel ratio control when an air/fuel ratio sensor is in an abnormal condition and thereby performs the each-cylinder air/fuel ratio control accurately.

To achieve the objective of the present invention, there is provided an air/fuel ratio control system for an internal combustion engine, which has a plurality of cylinders and an air/fuel ratio sensor. The air/fuel ratio sensor is disposed at an exhaust gas merging portion of an exhaust passage where exhaust gas discharged from the plurality of cylinders merges together. The air/fuel ratio control system includes an air/fuel ratio control means, an abnormality diagnosis means, and an enabling means. The air/fuel ratio control means is for individually controlling an air/fuel ratio of each of the plurality of cylinders based on an output of the air/fuel ratio sensor. The abnormality diagnosis means is for determining whether an abnormality of the air/fuel ratio sensor exists. The enabling means is for enabling the air/fuel ratio control means to execute the controlling of the air/fuel ratio of each of the plurality of cylinders when the abnormality diagnosis means determines that the abnormality of the air/fuel ratio sensor does not exist after starting of the engine.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
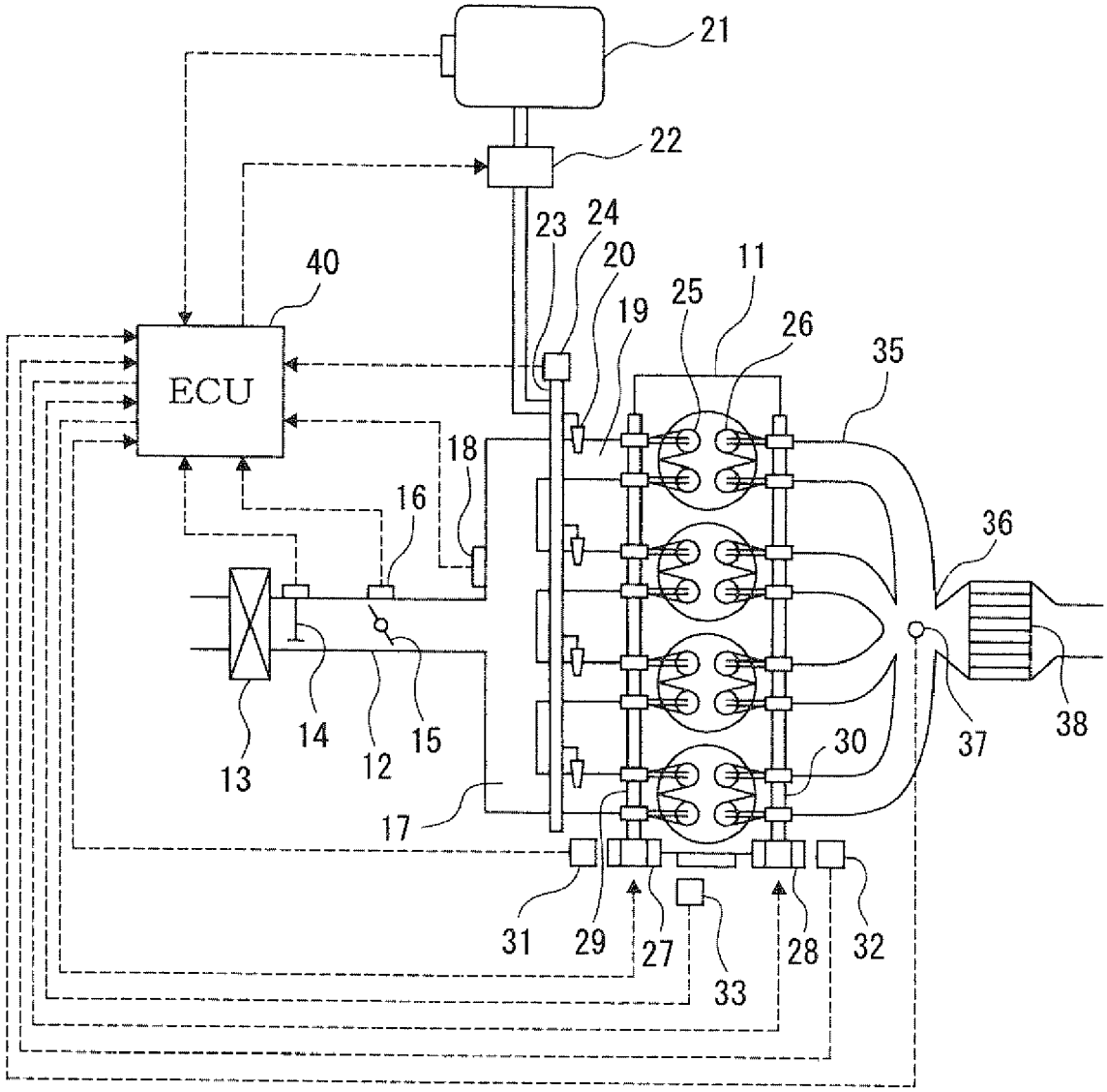
FIG. 1 is a schematic view illustrating a configuration of an overall engine control system according to an embodiment of the invention.

An embodiment of the invention is described below. Firstly, a schematic configuration of an overall engine control system is described with reference to FIG. 1.

An air cleaner 13 is disposed in an uppermost stream portion of an intake pipe 12 of an inline four-cylinder engine 11, which is an internal-combustion engine. An air flow meter 14 is disposed on a downstream side of the air cleaner 13 for detecting an amount of intake air. A throttle valve 15 and a throttle opening degree sensor 16 are disposed on a downstream side of the air flow meter 14. An opening degree of the throttle valve 15 is regulated by a motor or the like. The throttle opening degree sensor 16 detects opening degree (throttle opening degree) of the throttle valve 15.

A surge tank 17 is disposed on a downstream side of the throttle valve 15. An intake pipe pressure sensor 18 is disposed on the surge tank 17 for detecting intake pipe pressure. An intake manifold 19 is formed from the surge tank 17 for introducing air into each cylinder of the engine 11. A fuel injection valve 20 is attached near an intake port of the intake manifold 19 of each cylinder for injecting fuel. Fuel in a fuel tank 21 is delivered to a delivery pipe 23 by a fuel pump 22 when the engine 11 is in operation. Fuel is injected from the fuel injection valve 20 of each cylinder every injection timing for each cylinder. A fuel pressure sensor 24 is attached to the delivery pipe 23 for detecting pressure of fuel (fuel pressure).

Variable valve timing mechanisms 27, 28 are disposed in the engine 11 for varying opening/closing timings of an intake valve 25 and an exhaust valve 26, respectively. An intake cam angle sensor 31 and an exhaust cam angle sensor 32, and a crank angle sensor 33 are disposed in the engine 11. The intake cam angle sensor 31 and the exhaust cam angle sensor 32 output cam angle signals in synchronization with respective rotations of an intake cam shaft 29 and an exhaust cam shaft 30. The crank angle sensor 33 outputs a pulse of a crank angle signal at every predetermined crank angle (e.g., 30° CA) in synchronization with rotation of a crankshaft of the engine 11.

An air/fuel ratio sensor 37 is disposed at an exhaust air merging portion 36 where an exhaust manifold 35 for each cylinder of the engine 11 merges together. The air/fuel ratio sensor 37 detects an air/fuel ratio of exhaust gas. A catalyst 38 such as a three-way catalyst is disposed on a downstream side of the air/fuel ratio sensor 37. The catalyst 38 purifies carbon monoxide (CO), hydrocarbon (HC), and nitrogen oxide (NOx) in exhaust gas.

Output of various sensors such as the air/fuel ratio sensor 37 is inputted into an engine control circuit (hereinafter referred to as ECU) 40. The ECU 40 mainly includes a microcomputer, and controls a fuel injection quantity or ignition timing of the fuel injection valve 20 of each cylinder according to an operating condition of the engine 11 by executing various engine control programs stored in a read-only memory (storage medium) integrated into the ECU 40.

The ECU 40 serves as an abnormality diagnosis means by executing various air/fuel ratio sensor abnormal diagnosis routines (not shown). The ECU 40 determines whether the air/fuel ratio sensor 37 (a sensor element and a heater) has an abnormal electrical connection (e.g., a broken wire and a short circuit), and whether the air/fuel ratio sensor 37 has an abnormal responsivity and active time (time it takes for the air/fuel ratio sensor 37 to go into an active state).

The abnormal diagnosis of responsivity of the air/fuel ratio sensor 37 may be made in the following manner. For example, when the air/fuel ratio sensor 37 is in an idle state after it has gone into the active state, lean control whereby an air/fuel ratio of exhaust gas is varied in a lean direction and rich control whereby the air/fuel ratio of exhaust gas is varied in a rich direction are alternately performed. Then, an output variation of the air/fuel ratio sensor 37 in a predetermined period during the lean control and an output variation of the air/fuel ratio sensor 37 in a predetermined period during the rich control are respectively compared with an abnormity determination value, to determine whether the responsivity of the air/fuel ratio sensor 37 is abnormal.

Alternatively, when fuel injection is cut off after the air/fuel ratio sensor 37 has gone into the active state, an output change rate of the air/fuel ratio sensor 37 in a predetermined period after the fuel injection cut-off is started is calculated. Then, the output change rate of the air/fuel ratio sensor 37 is compared with an abnormity determination value, to determine whether the responsivity of the air/fuel ratio sensor 37 is abnormal. In addition, a response time after the fuel injection cut-off is started until an output of the air/fuel ratio sensor 37 reaches a predetermined value may be measured. Then, the response time is compared with an abnormity determination value to determine whether the responsivity of the air/fuel ratio sensor 37 is abnormal.

Furthermore, the ECU 40 performs the following air/fuel ratio control by executing an air/fuel ratio control routine (to be described in greater detail hereinafter) shown in FIG. 2.

When it is determined that the air/fuel ratio sensor 37 does not have the abnormal electrical connection, air/fuel ratio F/B (feedback) control is started at the time when a predetermined execution condition for the air/fuel ratio F/B control is satisfied, even before the abnormal diagnosis of the active time of the air/fuel ratio sensor 37 and the abnormal diagnosis of responsivity of the air/fuel ratio sensor 37 are ended (before it is determined whether the active time of the air/fuel ratio sensor 37 is abnormal and whether the responsivity of the air/fuel ratio sensor 37 is abnormal).

According to the air/fuel ratio F/B control, an air/fuel ratio F/B correction amount is calculated such that an air/fuel ratio detected in the air/fuel ratio sensor 37 when the engine 11 is in operation accords with a target air/fuel ratio. Then, by equally correcting a fuel injection quantity in each cylinder using the air/fuel ratio F/B correction amount, an air/fuel ratio of an air-fuel mixture supplied to each cylinder is equally corrected.

After this, the abnormal diagnosis of the active time of the air/fuel ratio sensor 37 and the abnormal diagnosis of responsivity of the air/fuel ratio sensor 37 are ended, and accordingly when it is determined that the air/fuel ratio sensor 37 is normal (the active time of the air/fuel ratio sensor 37 is not abnormal and the responsivity of the air/fuel ratio sensor 37 is not abnormal), air/fuel ratio F/B control for each cylinder is started at the time when a predetermined execution condition for the air/fuel ratio F/B control for each cylinder is satisfied.

According to the air/fuel ratio F/B control for each cylinder, an air/fuel ratio in each cylinder is estimated based on a detection value in the air/fuel ratio sensor 37 when the engine 11 is in operation using a model, in which the detection value in the air/fuel ratio sensor 37 (an air/fuel ratio of exhaust gas flowing at the exhaust air merging portion 36) is related with the air/fuel ratio in each cylinder. By calculating a difference between an estimated air/fuel ratio in each cylinder and a reference air/fuel ratio (an average value of estimated air/fuel ratios for all cylinders or a control target value), a variation of the air/fuel ratios among the cylinders is calculated. Then, the air/fuel ratio F/B correction amount is calculated for each cylinder such that the variation of the air/fuel ratios among the cylinders is small. Based on the calculated air/fuel ratio F/B correction amount, the fuel injection quantity in each cylinder is corrected for each cylinder. Accordingly, the variation of the air/fuel ratios among the cylinders is controlled to be small by correcting the air/fuel ratio of the air-fuel mixture supplied to each cylinder for each cylinder.

After the air/fuel ratio F/B control for each cylinder is started, both the air/fuel ratio F/B control and the air/fuel ratio F/B control for each cylinder may be executed. Alternatively, the air/fuel ratio F/B control is stopped so that only the air/fuel ratio F/B control for each cylinder may be executed.

Figure 2:
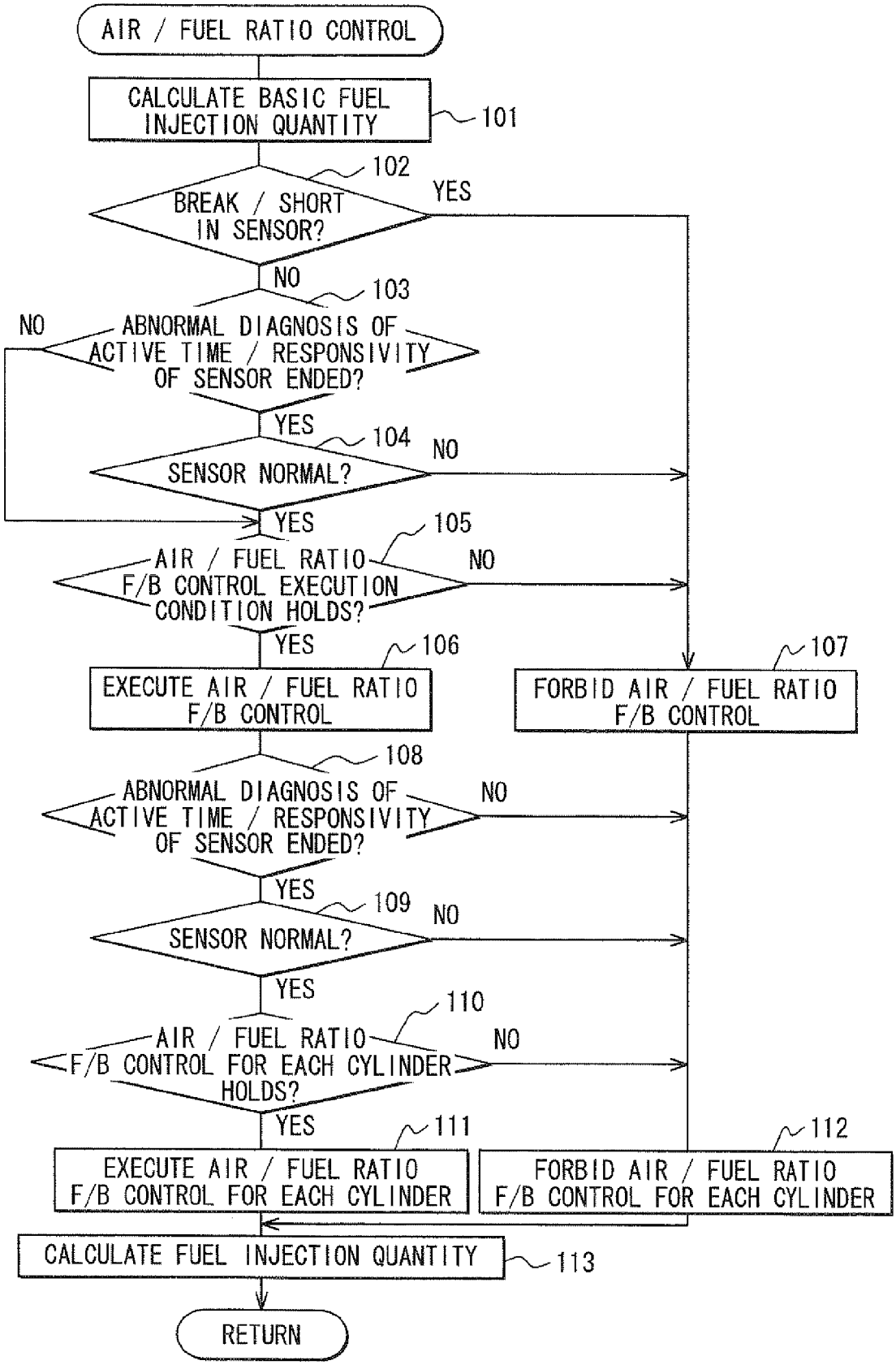
FIG. 2 is a flowchart illustrating a processing flow in an air/fuel ratio control routine according to the embodiment.

The air/fuel ratio control in the present embodiment is performed in the ECU 40 according to the air/fuel ratio control routine shown in FIG. 2. Processing in the routine is described below.

The air/fuel ratio control routine shown in FIG. 2 is executed at predetermined intervals while the ECU 40 is turned on, and serves as a second air/fuel ratio control means and an air/fuel ratio control means (first air/fuel ratio control means). When the routine is started, a basic fuel injection quantity is calculated at step 101 based on an operating condition of the engine 11 (e.g., a rotational speed of the engine 11 and a load).

After this, control proceeds to step 102, where it is determined whether the air/fuel ratio sensor 37 has the abnormal electrical connection. If it is determined that the air/fuel ratio sensor 37 has the abnormal electrical connection, the air/fuel ratio F/B control is forbidden, and the air/fuel ratio F/B control for each cylinder is forbidden (steps 107, 112).

If it is determined at step 102 that the air/fuel ratio sensor 37 does not have the abnormal electrical connection, control proceeds to step 103, where it is determined whether the abnormal diagnosis of the active time of the air/fuel ratio sensor 37 and the abnormal diagnosis of responsivity of the air/fuel ratio sensor 37 are ended. If it is determined that these abnormal diagnoses are ended, control proceeds to step 104, where it is determined whether the air/fuel ratio sensor 37 is normal (the active time of the air/fuel ratio sensor 37 is not abnormal and the responsivity of the air/fuel ratio sensor 37 is not abnormal).

If it is determined at step 103 that the abnormal diagnosis of the active time of the air/fuel ratio sensor 37 and the abnormal diagnosis of responsivity of the air/fuel ratio sensor 37 are not ended (it is not yet determined whether the active time of the air/fuel ratio sensor 37 is abnormal and whether the responsivity of the air/fuel ratio sensor 37 is abnormal), or if it is determined at step 104 that the air/fuel ratio sensor 37 is normal, control proceeds to step 105. At step 105, it is determined whether the execution condition for the air/fuel ratio F/B control is satisfied. If it is determined at step 105 that the execution condition for the air/fuel ratio F/B control is satisfied, control proceeds to step 106, where the air/fuel ratio F/B control is executed.

If it is determined at step 103 that the abnormal diagnosis of the active time of the air/fuel ratio sensor 37 and the abnormal diagnosis of responsivity of the air/fuel ratio sensor 37 are ended, and if it is determined at step 104 that the air/fuel ratio sensor 37 is abnormal (at least one of the active time and responsivity of the air/fuel ratio sensor 37 is abnormal), the air/fuel ratio F/B control is forbidden, and the air/fuel ratio F/B control for each cylinder is forbidden (steps 107, 112).

At step 108, it is determined whether the abnormal diagnosis of the active time of the air/fuel ratio sensor 37 and the abnormal diagnosis of responsivity of the air/fuel ratio sensor 37 are ended. If it is determined that the abnormal diagnosis of the active time of the air/fuel ratio sensor 37 and the abnormal diagnosis of responsivity of the air/fuel ratio sensor 37 are ended, control proceeds to step 109, where it is determined whether the air/fuel ratio sensor 37 is normal.

If it is determined at step 108 that the abnormal diagnosis of the active time of the air/fuel ratio sensor 37 and the abnormal diagnosis of responsivity of the air/fuel ratio sensor 37 are not ended, or if it is determined at step 109 that the air/fuel ratio sensor 37 is abnormal, control proceeds to step 112, where the air/fuel ratio F/B control for each cylinder is forbidden.

If it is determined at step 108 that the abnormal diagnosis of the active time of the air/fuel ratio sensor 37 and the abnormal diagnosis of responsivity of the air/fuel ratio sensor 37 are ended, and if it is determined at step 109 that the air/fuel ratio sensor 37 is normal, control proceeds to step 110, where it is determined whether the execution condition for the air/fuel ratio F/B control for each cylinder is satisfied. If it is determined that the execution condition for the air/fuel ratio F/B control for each cylinder is satisfied, control proceeds to step 111, where the air/fuel ratio f/B control for each cylinder is executed. In this case, both the air/fuel ratio F/B control and the air/fuel ratio F/B control for each cylinder may be executed. Alternatively, the air/fuel ratio F/B control is stopped so that only the air/fuel ratio F/B control for each cylinder may be executed.

After this, control proceeds to step 113, the basic fuel injection quantity for each cylinder is equally corrected using the air/fuel ratio F/B correction amount in the air/fuel ratio F/B control, and the basic fuel injection quantity for each cylinder is corrected using the air/fuel ratio F/B correction amount calculated for each cylinder in the air/fuel ratio F/B control for each cylinder, to calculate a final fuel injection quantity for each cylinder.

In the present embodiment, the air/fuel ratio F/B control for each cylinder is started at the time when the execution condition for the air/fuel ratio F/B control for each cylinder is satisfied after the determinations are made that the air/fuel ratio sensor 37 does not have the abnormal electrical connection, the abnormal diagnosis of the active time of the air/fuel ratio sensor 37 and the abnormal diagnosis of responsivity of the air/fuel ratio sensor 37 are ended, and that the air/fuel ratio sensor 37 is normal. A flow from step 109 (Yes) to step 111 via step 110 corresponds to an enabling means (first enabling means). Accordingly, execution of the air/fuel ratio F/B control for each cylinder when the air/fuel ratio sensor 37 is abnormal is prevented, and the air/fuel ratio F/B control for each cylinder is started after it is confirmed that the air/fuel ratio sensor 37 is normal. As a result, the air/fuel ratio F/B control for each cylinder is accurately executed.

Furthermore, when it is determined that the air/fuel ratio sensor 37 does not have the abnormal electrical connection, air/fuel ratio F/B control is started at the time when the execution condition for the air/fuel ratio F/B control is satisfied, even before the abnormal diagnosis of the active time of the air/fuel ratio sensor 37 and the abnormal diagnosis of responsivity of the air/fuel ratio sensor 37 are ended. A flow from step 103 (No) to step 106 via step 105 corresponds to a second enabling means. Accordingly, before the air/fuel ratio F/B control for each cylinder is started, exhaust gas emission is reduced by controlling the air/fuel ratio in each cylinder by the air/fuel ratio F/B control.

In addition, if it is determined that at least one of the active time and responsivity of the air/fuel ratio sensor 37 is abnormal, the air/fuel ratio F/B control and the air/fuel ratio F/B control for each cylinder are forbidden. However, even though the heater of the air/fuel ratio sensor 37 breaks down and thereby the active time of the air/fuel ratio sensor 37 becomes abnormal, for example, the air/fuel ratio F/B control and the air/fuel ratio F/B control for each cylinder are accurately executed after the air/fuel ratio sensor 37 is activated by exhaust heat as long as the responsivity of the air/fuel ratio sensor 37 is normal. Therefore, in such a case, the air/fuel ratio F/B control and the air/fuel ratio F/B control for each cylinder may be executed when it is determined that the responsivity of the activated air/fuel ratio sensor 37 is normal, regardless of whether the active time of the air/fuel ratio sensor 37 is abnormal.

Additional advantages and modifications will readily occur to those skilled in the art. The invention in its broader terms is therefore not limited to the specific details, representative apparatus, and illustrative examples shown and described.

What is claimed is:

1. An air/fuel ratio control system for an internal combustion engine, which has a plurality of cylinders and an air/fuel ratio sensor, wherein the air/fuel ratio sensor is disposed at an exhaust gas merging portion of an exhaust passage where exhaust gas discharged from the plurality of cylinders merges together, the air/fuel ratio control system comprising:

an air/fuel ratio control means for individually controlling an air/fuel ratio of each of the plurality of cylinders based on an output of the air/fuel ratio sensor;

an abnormality diagnosis means for determining whether an abnormality of responsivity of the air/fuel ratio sensor exists; and an enabling means for enabling the air/fuel ratio control means to execute the individually controlling of the air/fuel ratio of each of the plurality of cylinders when the abnormality diagnosis means determines that the abnormality of responsivity of the air/fuel ratio sensor does not exist after starting of the engine.

2. The air/fuel ratio control system according to claim 1, wherein:

the air/fuel ratio control means is a first air/fuel ratio control means; and the enabling means is a first enabling means;

the air/fuel ratio control system further comprising:

a second air/fuel ratio control means for uniformly controlling the air/fuel ratio of each of the plurality of cylinders based on the output of the air/fuel ratio sensor; and a second enabling means for enabling the second air/fuel ratio control means to execute the controlling of the air/fuel ratio of each of the plurality of cylinders before the abnormality diagnosis means determines whether the abnormality of responsivity of the air/fuel ratio sensor exists after the starting of the engine.

3. The air/fuel ratio control system according to claim 1, further comprising means for calculating a difference between an estimated air/fuel ratio of each cylinder and a reference air/fuel ratio, and calculating a variation of the air/fuel ratios among the cylinders.

4. The air/fuel ratio control system according to claim 3, wherein the variation of the air/fuel ratios among the cylinders is controlled to be small.

5. A method of controlling an air/fuel ratio for an internal combustion engine, which has a plurality of cylinders and an air/fuel ratio sensor, wherein the air/fuel ratio sensor is disposed at an exhaust gas merging portion of an exhaust passage where exhaust gas discharged from the plurality of cylinders merges together, the method comprising:

individually controlling an air/fuel ratio of each of the plurality of cylinders based on an output of the air/fuel ratio sensor;

determining whether an abnormality of responsivity of the air/fuel ratio sensor exists; and executing the individual control of the air/fuel ratio of each of the plurality of cylinders when it is determined that the abnormality of responsivity of the air/fuel ratio sensor does not exist after starting of the engine.

6. The method according to claim 5, further comprising:

uniformly controlling the air/fuel ratio of each of the plurality of cylinders based on the output of the air/fuel ratio sensor; and executing control of the air/fuel ratio of each of the plurality of cylinders before it is determined whether the abnormality of responsivity of the air/fuel ratio sensor exists after the starting of the engine.

7. The method according to claim 5, further comprising calculating a difference between an estimated air/fuel ratio of each cylinder and a reference air/fuel ratio, and calculating a variation of the air/fuel ratios among the cylinders.

8. The method according to claim 7, wherein the variation of the air/fuel ratios among the cylinders is controlled to be small.

* * * * *